US005647738A

United States Patent [19]

Tsai

[11] Patent Number: 5,647,738

[45] Date of Patent: Jul. 15, 1997

[54] JET TYPE GAS BURNER

[76] Inventor: Chin-Lin Tsai, 3 F, No. 94, Sec. 4, Chung Hsin Rd., San Chung City, Taipei Hsien, Taiwan

[21] Appl. No.: 545,515

[22] Filed: Oct. 19, 1995

[51] Int. Cl.[6] ..... F23Q 7/12

[52] U.S. Cl. ..... 431/255; 431/344; 431/266; 431/247

[58] Field of Search ..... 431/344, 255, 431/266, 232, 233, 234, 242, 244, 247

[56] References Cited

U.S. PATENT DOCUMENTS

| | | | |
|---|---|---|---|
| 4,726,767 | 2/1988 | Nakajima | 431/255 |
| 4,954,078 | 9/1990 | Nelson | 431/255 |

FOREIGN PATENT DOCUMENTS

| | | | |
|---|---|---|---|
| 361022113 | 1/1986 | Japan | 431/242 |

*Primary Examiner*—Carl D. Price
*Attorney, Agent, or Firm*—Bucknam and Archer

[57] ABSTRACT

A jet type gas burner includes a gas supply device, a control device, a piezo-electric device, a return device, a burning device and a housing. A base of the gas supply device is connected to a gas container such that the gas may pass into the base. An adjust rod of the control device is disposed in a hole of the base for controlling the amount of gas flow into the base, and its displacement may be controlled by means of a control knob. The gas enters an extension tube of the gas supply device through a relay seat and a return tube of the control device and is ejected through a jet gas nozzle into a mixing chamber of the burning device to mix with drawn-in air. The mixture is ejected through a nozzle and a plurality of auxiliary flame holes. By means of pressing a button on the gas burner, the piezo-electric device causes sparks to be generated by a conductive needle adjacent the nozzle to ignite the mixture of gas and air, and the flames are emitted from the nozzle as well as the flame holes. The auxiliary flames are provided to heat the return tube to promote gasification so as to enhance the burning effects and to prevent waste of fuel.

14 Claims, 6 Drawing Sheets

JET TYPE GAS BURNER

BACKGROUND OF THE INVENTION (a) Field of the Invention

The present invention relates generally to a gas burner, and more particularly to a jet type gas burner which provides enhanced burning effects and prevents waste of fuel gas.

(b) Description of the Prior Art

Conventional torch lamps mainly consist of a fuel cylinder, a pump device, a collecting tank, a control switch and a nozzle. In use, the fuel (gasoline) is firstly poured into the fuel cylinder. Pressure is then exerted on the pump device to pump some of the fuel to the collecting tank above. The control switch is then switched off. A match or a lighter is used to ignite the fuel in the collecting tank to heat the nozzle until the fuel in the collecting tank is almost used up before the control switch is switched on. Welding operation can then proceed by utilizing the fuel left in the collecting tank to ignite the nozzle. As can be seen, the operation of the conventional torch lamp is very complicated. Besides, filling of gasoline into the torch lamp will easily cause precipitation of impurities in the fuel cylinder, and which may clog the nozzle. Once the nozzle is clogged, fine needle-like objects have to be inserted into the nozzle to remove the clogging substances, which may easily damage the nozzle. Furthermore, for the purposes of safety, torch lamps are not used at home as a necessary tool.

As is well known, liquid gas has been quite popular since it may be used in cigarette lighters or stored in containers for connection with portable gas stoves for cooking. The convenience and facility offered by gas containers have promoted co-existence of two types of torch lamps. In U.S. patent application Ser. No. 08/382,628, a gas outlet at an upper side of a gas container is pivotally connected to a gas inlet in the bottom side of a conventional torch lamp. Liquid gas is poured into the fuel cylinder to supply fuel gas for a gas outlet device above a flame nozzle. In U.S. Pat. No. 4,804,324 to Prince Industrial Development Co., Ltd., a torch lamp has a receiving device at a bottom side thereof for pivotal connection with a conventional gas container. The gas, after gasification, provides the torch lamp with the necessary fuel for burning. The torch lamp may then be used in welding or other kinds of operation.

At places where the ambient temperature may be lower than the gasification point of the gas, the gas in the gas container may undergo incomplete gasification, which may result in poor ignition as well as waste of fuel.

SUMMARY OF THE INVENTION

A primary object of the present invention is to provide a jet type gas burner which eliminates the drawbacks in the prior art.

Another object of the present invention is to provide a jet type gas burner which may enhance burning effects and prevents undue waste of fuel gas.

BRIEF DESCRIPTION OF THE DRAWINGS

The foregoing and other features and advantages of the present invention will be more clearly understood from the following detailed description and the accompanying drawings, in which.

FIG. 4-1 is a sectional view of FIG. 4, taken along line A—A;

FIG. 5-1 is a sectional view of FIG. 5, taken along line B—B; and

DETAILED DESCRIPTION OF THE PREFERRED EMBODIMENT

Figure 1:
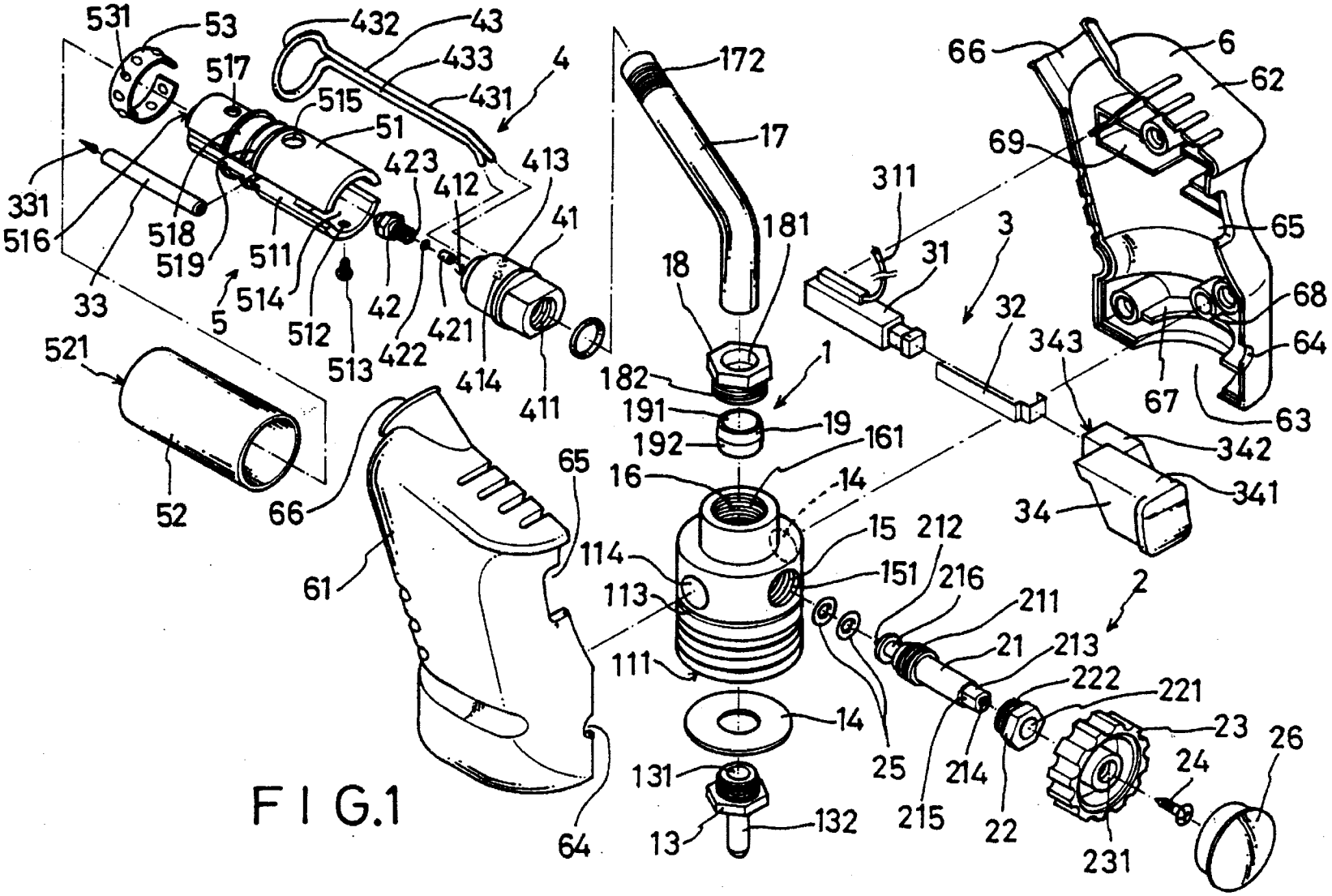
FIG. 1 is a perspective exploded view of the gas burner of the invention.

With reference to the drawings, the gas burner of the invention essentially comprises a gas supply device 1, a control device 2, a piezo-electric device 3, a return device 4, a burning device 5 and a housing 6.

Figure 2:
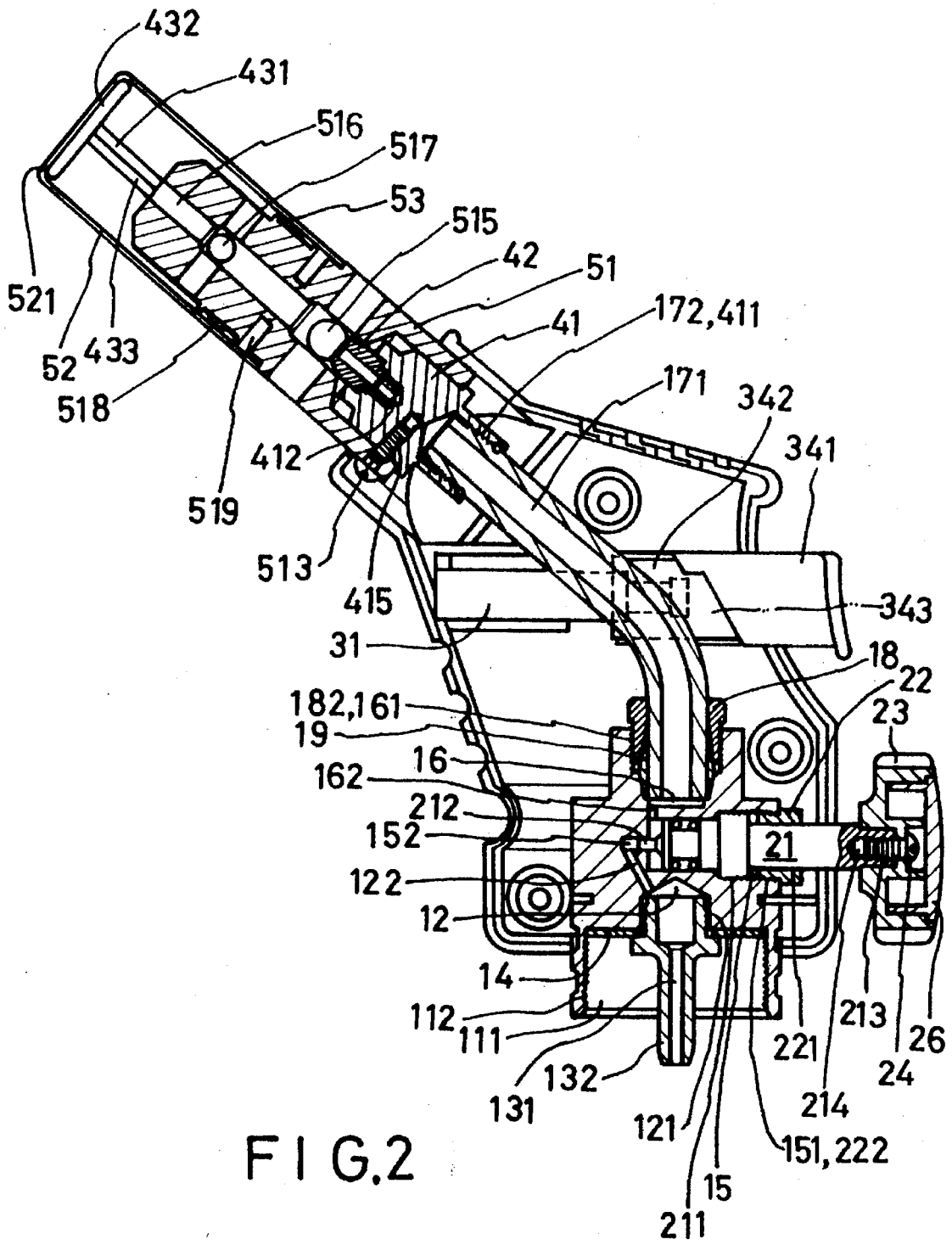
FIG. 2 is a schematic sectional view of the gas burner of the invention in an assembled state.

With reference to FIGS. 1 and 2, the gas supply device 1 includes a cylindrical base 11. The base 11 has a round hole 111 in its bottom side and threads 112 around an inner periphery of the round hole 111 for engagement with external threads of a conventional gas container. Another hole 12 of a smaller diameter is provided above the round hole 111. The hole 12 communicates with the round hole 111 and is provided with internal threads 121 for engaging with an insert nozzle 13 having a through hole 131 in a central portion thereof and a needle-like connecting rod 132 at a lower portion thereof. The connecting rod 132 may be connected to a gas outlet of the conventional gas container so that fuel gas may enter through the through hole 131 into the base 11. In order to prevent leakage of gas, a gasket 14 is disposed between the insert nozzle 13 and the hole 12 of the base 11.

In addition, a base hole 15 having internal threads 151 is laterally provided in a rear side of the base 11 for engaging with the control device 2. The base hole 15 communicates with a neck hole 152 of a smaller diameter provided at its front end. The neck hole 152 in turn communicates with the hole 12 via a slanting gas duct 122 so that the gas may pass therethrough into the base hole 15.

The base 11 further has a connecting hole 16 with internal threads 161 formed at an upper side thereof. The connecting hole 16 communicates with the base hole 15 via a through hole 162 of a smaller diameter disposed therebetween. In assembly, an extension tube 17 is firstly bent before being passed through a through hole 181 in a central portion of a connecting seat 18 and a ring hole 191 of a packing ring 19, such that the packing ring 19 has a major portion located in the through hole 181. The connecting seat 18 together with the packing ring 19 are then fitted into the connecting hole 16 of the base by means of external threads 182 at a lower portion of the connecting seat 18 engaging with internal threads 161 of the connecting hole 16. Since the packing ring 19 has a flank 192 on its outer periphery, the flank 192 will press against the extension tube 17 when the packing ring 19 is fitted along with the connecting seat 18 into the connecting hole 16 of the base 11, so that fuel gas will not escape through the connecting hole 16 or the connecting seat 18. Besides, fuel gas may be guided into the extension tube 17. The reason why the packing ring 19 is employed in this invention for the prevention of gas leakage in place of the conventional gaskets or O-rings is that when fuel gas passes through a multi-pass neck portion of the base 11 (such as neck hole 152 and through hole 162), its pressure will increase, and conventional means like gaskets cannot be relied upon to effectively prevent any possible gas leakage. In this invention, the packing ring 19 is configured to be made of metal and the flank 192 is utilized to press against the extension tube 17 to stop any possible leakage of gas. Additionally, the extension tube 17 is internally provided with a duct 171 and threads 172 around an upper portion thereof for engagement with the return device 4 to be described hereinafter.

The control device 2 includes an adjusting screw rod 21 passing into the base hole 15. The screw rod 21 has external threads 211 on a front portion thereof for engagement with the threads 151 of the base hole 15 so that the adjusting screw rod 21 may displace laterally within the base hole 15. The adjusting screw rod 21 further has a cylindrical first post 212 disposed in front of the threads 211 and which has a size matching that of the neck hole 152. When the invention is not in use, the cylindrical post 212 is accommodated in the neck hole 152 to prevent entrance of fuel gas into the base hole 15. The adjusting screw rod 21 additionally has a second post 213 at an end thereof opposite to the first post 212. The second post 213 has a hole 214 and a plurality of milled surfaces 215. In assembly, a detent screw 22 having a through hole 221 is fitted onto the adjusting screw rod 21, which is then fastened into the base hole 15, with threads 222 of the detent screw 22 engaging with the threads 151 of the base hole 15, so that the detent screw 22 serves as a limit for the rearward displacement of the adjust screw rod 21. Subsequently, a control knob 23 having a central through hole 231 is fitted onto the milled surfaces 215 of the second post 213, and a screw 24 is driven through the hole 231 into the hole 214 of the adjust screw rod 21 and locked therein. By means of this arrangement, when the control knob 23 is turned, the adjust screw rod 21 will perform lateral displacement within the base hole 15, causing the first post 212 to open or close the neck hole 152 to control passage of fuel gas. In order to prevent gas leakage, more than one gasket 25 may be provided on a neck portion 216 between the first post 212 and the threads 211. Furthermore, in order to conceal the screw 24, a cap 26 may be fitted onto the control knob 23.

The piezo-electric device 3 is disposed at one side of the control device 2 and chiefly consists of a piezo-electric means 31 and a conductive plate 32 accommodated within the housing 6. A lead wire 311 at a front end of the piezo-electric means 31 extends to the burning device 5 and passes through a ceramic spindle 33 before coming into contact with a conductive needle 331 therein to make the connection. A push-button 34 is provided at a rear end of the piezo-electric means. In order to prevent the push-button 34 from coming into contact with the extension tube 17 in case it is too long, the push-button 34 is configured to have a first button element 341 and a second button element 342 extending from one side of the first button element and running parallel thereto. The second button element 342 further has a recess 343 for accommodating the piezo-electric means 31 and the conductive plate 32. In operation, the first button element 341 is pressed so that it presses against the piezo-electric means 31, causing the conductive needle 331 to generate sparks. After pressing, the piezo-electric means 31 will retract, causing the second button element 342 to urge against an inner wall of the housing 6, simultaneously preventing the push-button 34 from slipping out of the housing 6.

Figure 4A:
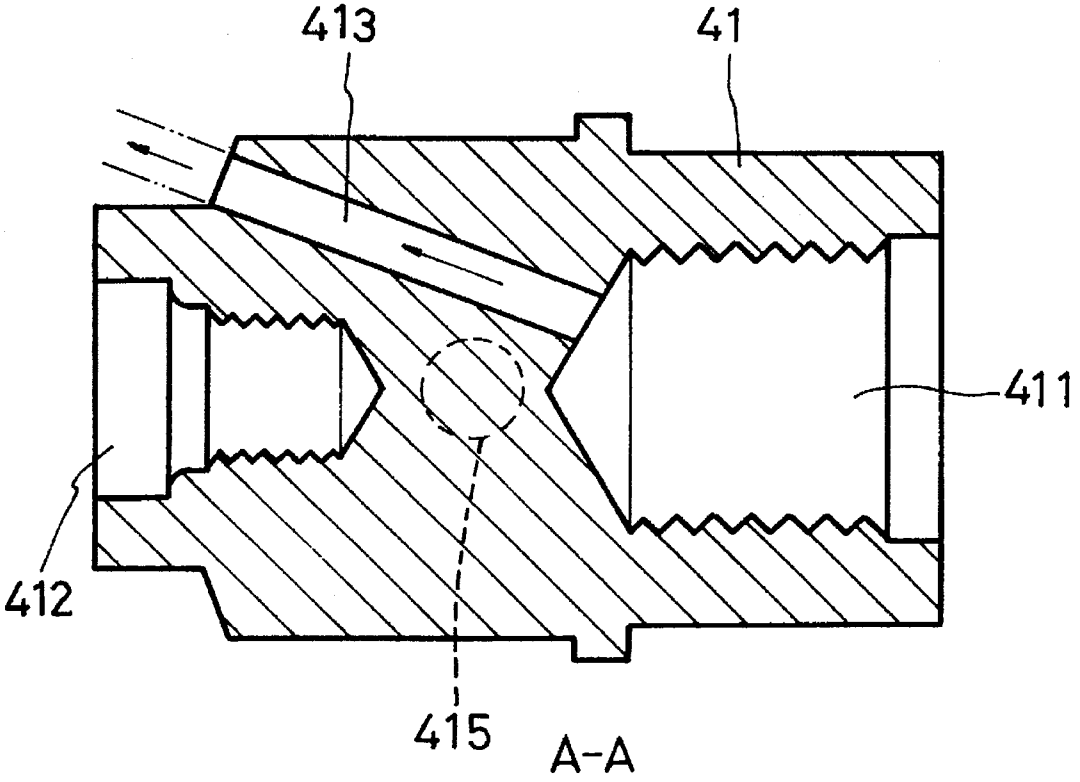
FIG. 4 is a top view of the relay seat of the gas burner of the invention.
Figure 4:
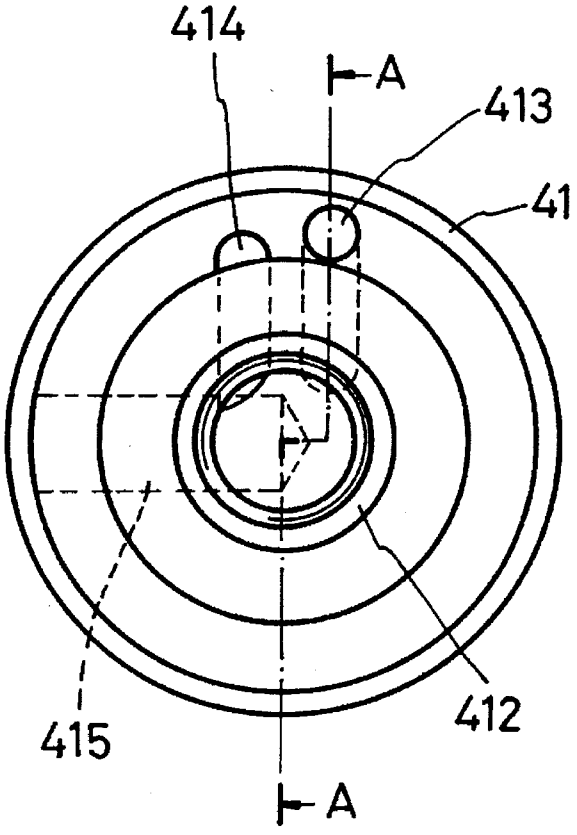
Figure 5A:
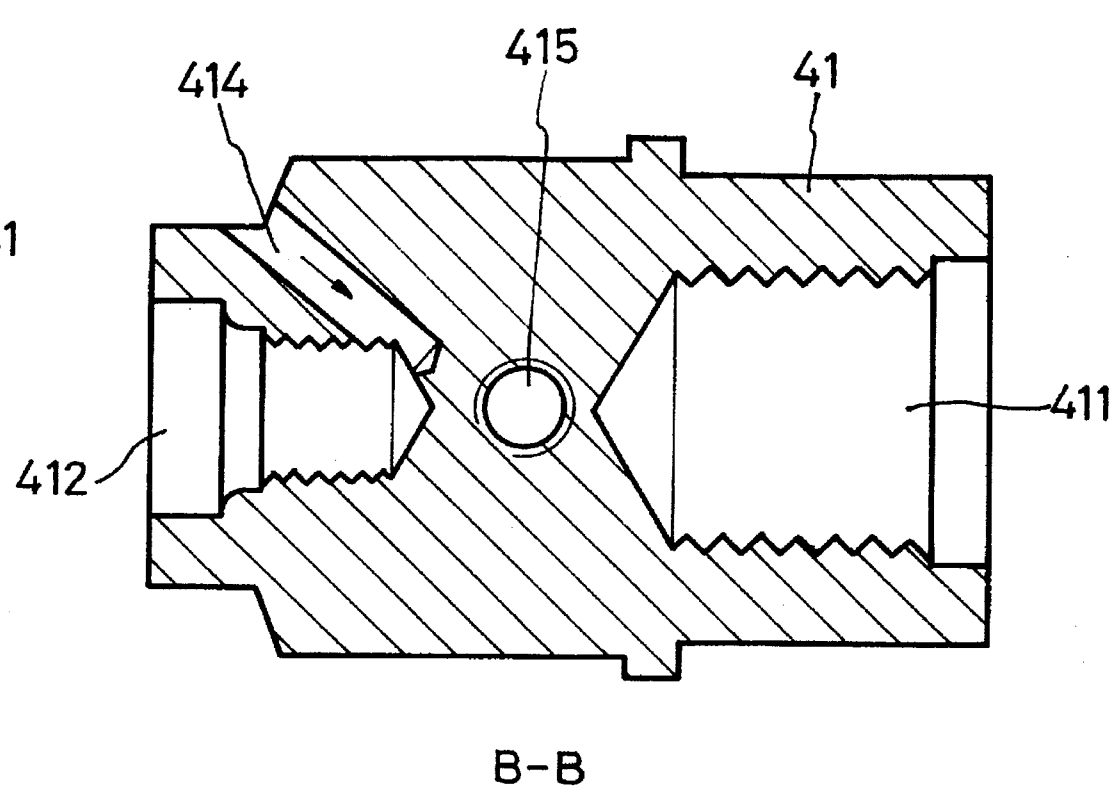
FIG. 5 is another top view of the relay seat of the gas burner of the invention.
Figure 5:
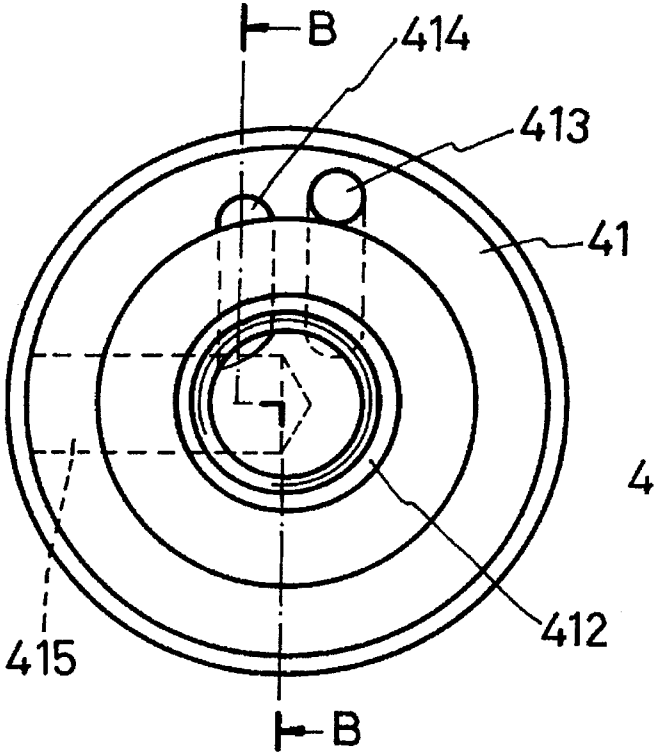

The return device 4 mainly includes a relay seat 41 having a threaded relay hole 411 formed at a rear end thereof for receiving the extension tube 17 and a threaded gas outlet 412 at a front end thereof for locking with a gas nozzle 42. With reference to FIGS. 4 and 5, the relay hole 411 is provided with an upwardly inclined insert hole 413 in an upper side thereof for receiving a first intake tube 431 of a return tube 43. The return tube 43 has an annular tube 432 at a front end thereof, which is connected with a second intake tube 433, which is in turn linked to a downwardly inclined connecting hole 414 in the upper side of the relay seat 41, such that the connecting hole 414 communicates with the gas outlet 412 to form a loop. A copper tube 421 and a filter mesh 422 may be disposed in a hole 423 of the gas nozzle 42 to filter out impurities. The gas nozzle 42 is then connected to the gas outlet 412 to accomplish the return device. When the gas nozzle 42 ejects fuel gas, which is ignited by the sparks generated by the conductive needle 331 when the push-button 34 is pressed, the flame thus produced will heat the annular tube 432, speeding up gasification of the fuel gas inside the return tube 43 and increasing the pressure therein, resulting in enhanced burning effects.

The burning device 5 is comprised of a hollow terraced cylindrical mixing tube 51. A groove 511 is provided in both the left and the right sides of the mixing tube 51 for accommodating and positioning the first intake tube 431, the second intake tube 433, and the spindle 33. The mixing tube 51 further has a central hole 512 at a rear bottom end thereof for passage of a screw 513 therethrough into a hole 415 formed in the bottom side of the relay seat 41, so that the relay seat 41 may be secured with the mixing tube 51. At the same time, in order to facilitate passage of air into a mixing chamber 514 of the mixing tube 51 to mix with the fuel gas, a plurality of air holes 515 may be formed in both the lateral and the longitudinal sides of the mixing tube 51 at suitable positions. The mixture of air and gas ejected via a nozzle 516 at a front end of the mixing chamber 514 will be ignited when the push-button 34 is pressed to cause the conductive needle 331 to generate sparks by means of the piezo-electric means 31 and its lead wire 311.

In addition, in order that the flame thus produced may not be blown off, a plurality of auxiliary flame holes 517 may be disposed near the front end of the mixing tube 51 in a longitudinal, lateral or slanting manner, so that the mixture of air and gas may escape through these flame holes 517 and may also be ignited when the conductive needle 311 generates sparks. Even if the flame at the nozzle 516 is blown off, the flames at the flame holes 517 may be maintained. Besides, the flames at the flame holes 517 may enhance heating of the annular tube 432. An outer tube 52 is then fitted onto the first half section of the mixing tube 51 to direct the flame and check the auxiliary flames from extending forwardly. Moreover, in order to prevent the return tube 43 from slipping out of the outer tube 52, a shrinkage tube 521 is provided at a front end portion of the outer tube 52, which urges against the annular tube 432.

Figure 3:
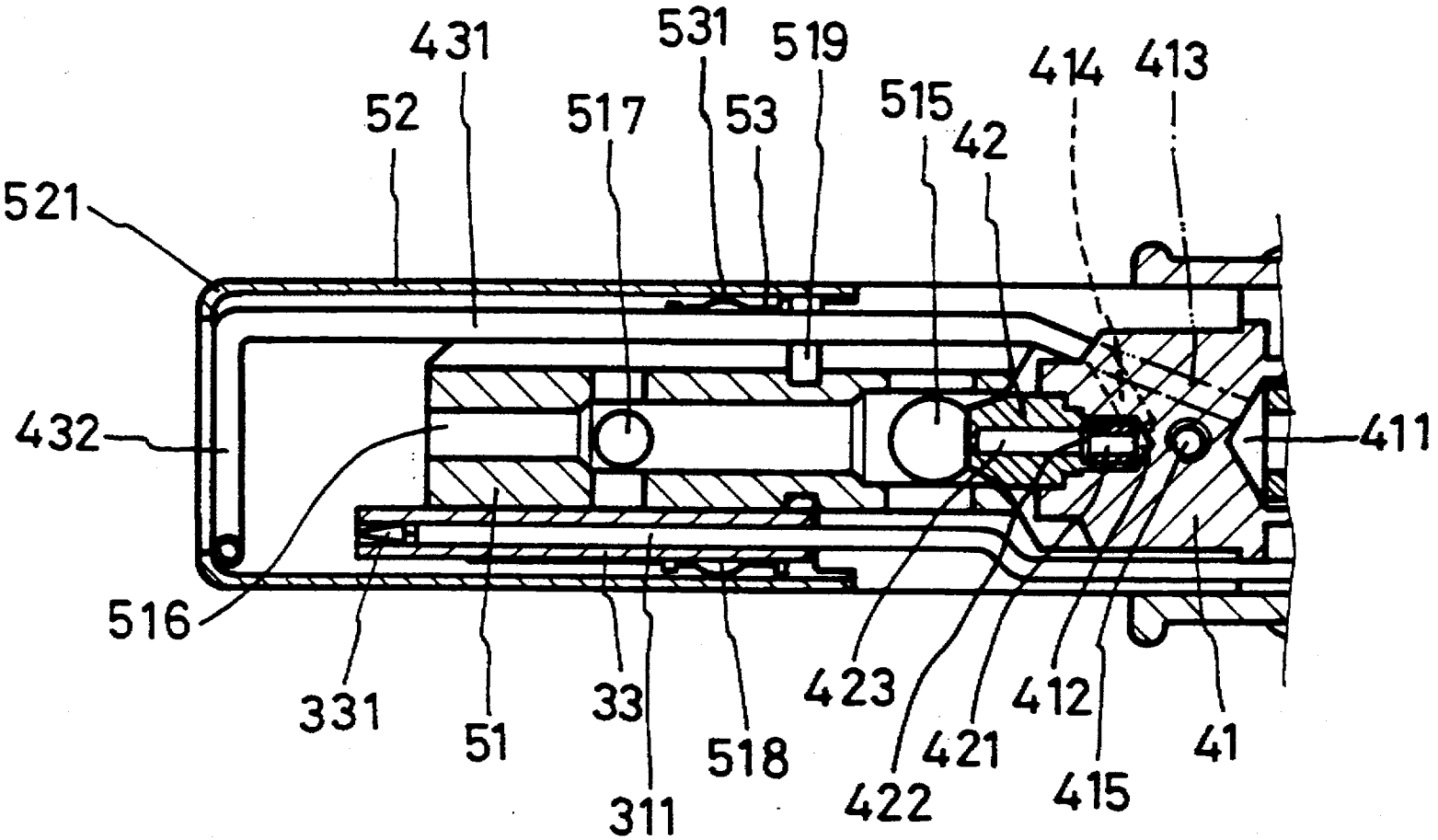
FIG. 3 is a partially enlarged view of the gas burner of the invention, illustrating the return device and the burning device.

In addition, an insulation ring 53 made of metal is fitted around a neck portion 518 of the mixing tube 51 behind the flame holes 517 to prevent conduction of heat to the mixing tube 51. The insulation ring 53 is a resilient member having a multiplicity of bosses 531 provided thereon. Aside from maintaining point contact with the outer tube 52, the insulation ring 53 also positions the outer tube 52 and the mixing tube 51, so that the heat generated by the outer tube 52 is conducted to mixing tube 51 by the bosses 531 to reduce heat transfer. Besides, in order to prevent the rear end of the mixing tube 51 from becoming overheated which may melt the housing 6, a groove 519 may be formed behind the neck portion 518 of the mixing tube 51 to check transfer of heat from the front portion of the mixing tube 51 to the rear portion thereof. Please refer to FIG. 3, a sectional view of the return device 4 and the burning device 5 as assembled.

The housing 6 consists of a left housing 61 and a right housing 62 joined together for containing most of the above-described components. After assembly, the housing 6 has a hole 63 for exposing the round hole 111 of the base 11. Holes 64, 65 and 66 are respectively formed in the housing 6 at suitable positions for exposing parts of the adjust screw rod 21, the first button element 341 and the mixing tube 51. An annular rib 67 and positioning posts 68 are provided at a lower portion of the housing 6 for positioning the base 11. Correspondingly, the base 11 has a slot 113 and positioning holes 114. Therefore, when the left and the right housings 61, 62 are screwed tight, the housing 6 may enclose the base 11 to prevent it from falling downwardly. At the same time, the right housing 62 has a compartment 69 provided at a position corresponding to that of the recess 343 of the second button element 342 for accommodating the piezo-electric means 31 so that the piezo-electric means 31 may be located between the compartment 69 and the recess 343.

Figure 6:
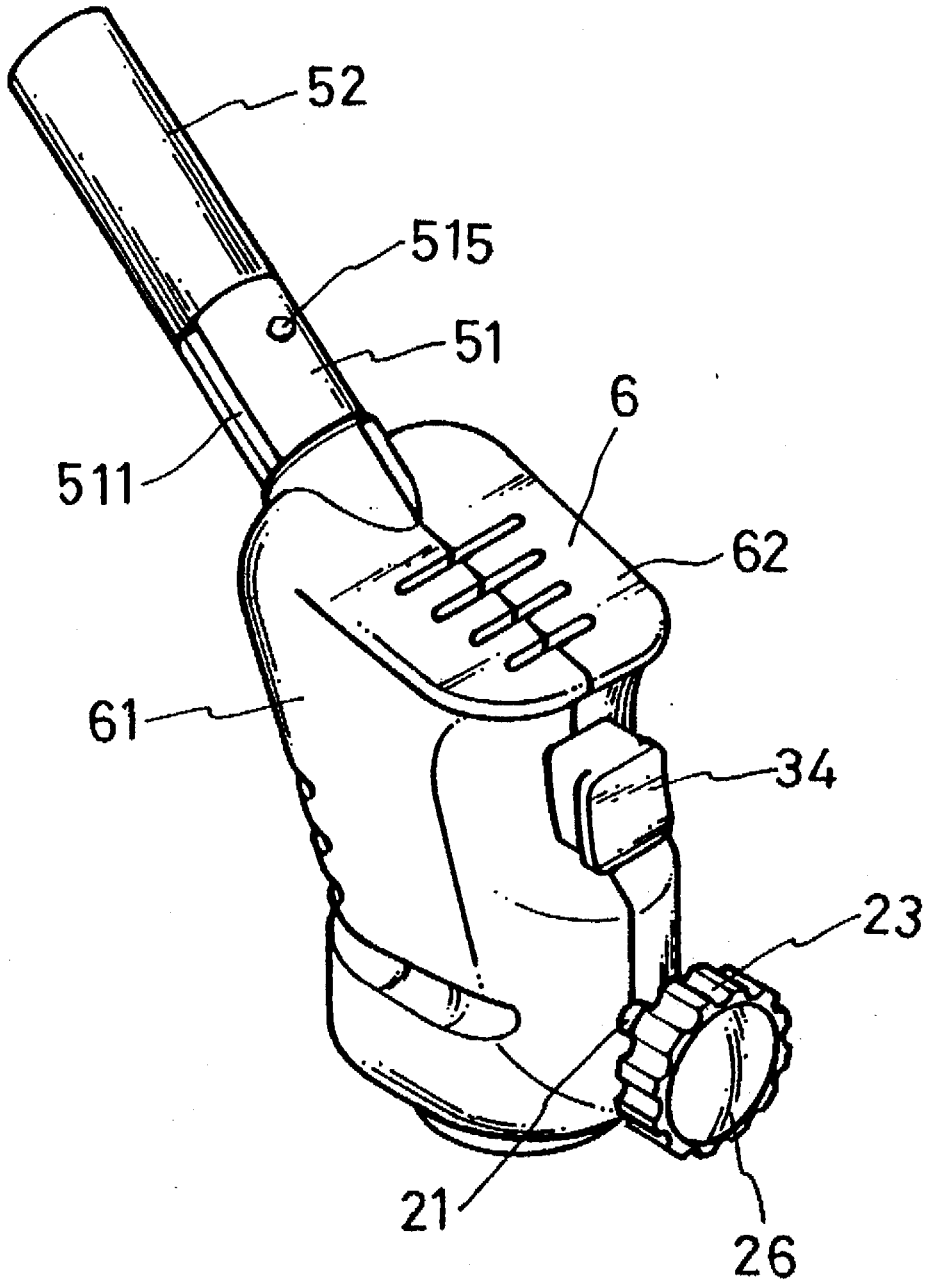
FIG. 6 is a schematic perspective view of the gas burner of the invention in an assembled state.

FIG. 6 illustrate the perspective view of the gas burner according to the invention after assembly of all the components described above is accomplished.

Operation of the gas burner of the invention will now be described with further reference to the drawings. The externally threaded portion of a conventional gas container is caused to engage with the internal threads 112 of the round hole 111 of the base 11, such that the connecting rod 132 of the insert nozzle 13 communicates with a gas discharge valve of the gas container. The fuel gas will then enter via the through hole 131 into the hole 12, the gas duct 122 and neck hole 152 of the base 11. By turning the control knob 23 to control the lateral displacement of the adjust screw rod 21 within the base hole 15, the amount of gas flow into the base hole 15 may be regulated. The fuel gas then passes through the through hole 162 into the duct 171 of the extension tube 17 via the relay hole 411, insert hole 413, return tube 43, connecting hole 414 and gas outlet 412 and out through the gas nozzle 42 of the return device 4 into the burning device 5. The fuel gas in the mixing chamber 514 circulates therein in a quick fashion, so that air is drawn in via air holes 515 into the mixing chamber 514 to mix with the fuel gas. The mixture then flows out via the nozzle 516 and the flame holes of the burning device 5. At this time, if the push-button 34 is pressed, causing the piezo-electric means 31 to generate static electricity which is conducted via the lead wire 311 to generate sparks at the conductive needle 331 near the nozzle 516, the mixture at the nozzle 516 will be ignited, and the flames thus produced are ejected through the nozzle 516 and the flame holes 517. The auxiliary flames at the flame holes 517 may preheat the return tube 43 and enhance gasification therein so as to enhance the burning effects and save fuel.

Advantages achievable by the gas burner according to the present invention are as follows:

1. The return device 4 of the invention enables fuel gas in the annular tube 432 to be subjected to preheating by the auxiliary fires, which not only promotes gasification (e.g., the ambient temperature is lower than that required for the gasification of the liquid gas) but also increases the pressure generated by the preheated fuel gas, so that the fuel gas may be more quickly ejected from the gas nozzle 42 into the burning device 5 to form gas currents, inducing outside air into the mixing chamber 514 via the air holes 515 to facilitate burning.
2. By means of the arrangement of auxiliary flames, the return tube 43 may be preheated and the mixture of fuel gas and air at the nozzle 516 may be re-ignited even if the flame at the nozzle 516 has been previously blown off.
3. Since the insulation ring 53 is provided with bosses 531, only very little heat is transferred from the outer tube 52 to the mixing tube 51. Besides, the arrangement of the groove 519 in the mixing tube 51 prevents the heat of the mixing tube 51 from melting the housing 6.
4. The extension tube 17 and the base 11 are connected via the connecting seat 18 which presses against the packing ring 19 with the flank, so that the direction of the fuel gas may be maintained and the leakage of gas prevented.
5. The arrangement of the control knob 23 facilitates control of the opening or closing of the neck hole 152 of the base 11 and regulation of the gas outflow.
6. The configuration of the first button element 341 and the second button element 342 prevents the push-button 43 from touching the extension tube 17 when it is pressed. Besides, the fuel gas at the nozzle 516 may be ignited when the push-button 43 is pressed down.
7. The housing 6 and the base 11 have matching positioning members so that the base 11 may not disengage from the base housing 6.

Although the present invention has been illustrated and described with reference to the preferred embodiment thereof, it should be understood that it is in no way limited to the details of such embodiment but is capable of numerous modifications within the scope of the appended claims.

What is claimed is:

1. A jet type gas burner comprising:

a) a gas supply device including a base member having a first end adapted for connection to a conventional gas container and a second end connected to an extension tube and having a gas passageway therebetween, and a lateral control bore arranged in said gas supply device and terminating at a necked down portion of said gas passageway, b) a control device including an adjusting rod received in the lateral control bore of said gas supply device and means for moving said adjusting rod in said control bore, said adjusting rod having valve means associated therewith to control the flow of gas passing through the necked down portion of the gas passageway of said gas supply device in response to the movement of said adjusting rod, c) an ignition means including a piezo-electric means, a conductive plate and an activating push button, d) a return device including a relay seat and a return tube, said relay seat having a first gas passageway having first and second ends, and a second gas passageway having first and second ends, the first end of said first gas passageway communicating with said extension tube and the first end of said second gas passageway communicating with a gas nozzle at a gas outlet of said relay seat, said return tube including a first intake tube communicating with a second end of said first gas passageway, a second intake tube communicating with a second end of said second gas passageway, and an annular hollow tube interconnecting said first and second intake tubes, e) a burning device including a hollow, terraced cylindrical mixing tube defining a mixing chamber into which the gas outlet of the relay seat of said return device extends, said relay seat being secured to said mixing tube, said mixing tube having a plurality of air holes for drawing ambient air into said mixing chamber when gas currents are generated therein by gas exiting from the gas nozzle of the relay seat of said return device so that said air and gas are mixed therein, downstream from said mixing chamber said mixing tube including a flame nozzle and a plurality of auxiliary flame holes whereby a mixture of air and gas may escape through said flame nozzle and auxiliary flame holes so that when said ignition means is activated the mixture of air and gas at said flame nozzle and said auxiliary flame holes is ignited, said annular hollow tube of said return tube being arranged so as to be heated by the ignited mixture of air and gas exiting said auxiliary flame holes, and an outer tube surrounding said mixing tube and defining a clearance between an inner wall thereof and said auxiliary flame holes so as to guide the ignited mixture of air and gas exiting said auxiliary flame holes forwardly, and f) a housing including a left side and a right side joined together to enclose said gas supply device, control device, ignition means, return device and burning device.

2. The jet type gas burner as defined in claim 1, wherein said gas nozzle of said return device includes a filter mesh held by a copper tube for filtering impurities in the gas fuel.

3. The jet type gas burner as defined in claim 1, wherein said mixing tube includes a pair of oppositely disposed longitudinal grooves for accommodating and positioning said first intake tube and said second intake tube of said return device and a lead wire of said piezo-electric means.

4. The jet type gas burner as defined in claim 1, wherein the mixing tube of said burning device has a neck portion behind said auxiliary flame holes, said neck portion having an insulation ring fitted thereon, said insulation ring having a multiplicity of bosses provided thereon for obstructing transfer of heat from said outer tube to said mixing tube.

5. The jet type gas burner as defined in claim 1, wherein the mixing tube of said burning device includes an annular groove provided between said auxiliary flame holes and said air holes so as to obstruct heat transfer therebetween.

6. The jet type gas burner as defined in claim 1, wherein the outer tube of said burning device includes a shrinkage tube urging against the annular hollow tube of the return tube of said return device for preventing said return tube from dislodgement.

7. The jet type gas burner as defined in claim 1, wherein the base member of said gas supply device is cylindrically shaped and has a threaded round bore disposed in a bottom end thereof for connection with the gas container, said threaded round bore communicating with a passageway in said base member which includes an insert nozzle having a needle-like connecting rod connected to a gas outlet of the gas container, said passageway communicating with the lateral control bore of said base member having internal threads for engagement with said control device and communicating with the necked down portion of the gas passageway of the gas supply device, said necked down portion of the gas passageway in turn communicating with the passageway connected to said insert nozzle via a slanting gas duct, said base member further having an internally threaded connecting bore at an upper side communicating with the lateral control bore of said base member via a through bore of smaller diameter disposed therebetween, said connecting bore further communicating with said extension tube, said extension tube being connected at one end to said base member and at an opposite end to the relay seat of said return device to form a gas path.

8. The jet type gas burner as defined in claim 7, wherein a gasket is disposed between the threaded round hole of said base member and said insert nozzle for preventing gas leakage.

9. The jet type gas burner as defined in claim 7, wherein said extension tube extends through a through bore in a connecting seat and a ring bore of a packing ring, said packing ring having a large portion thereof accommodated within the through bore of said connecting seat, said connecting seat having an externally threaded lower portion connected with said internally threaded connecting bore of said base member, said packing ring having a flank on its outer periphery, said flank pressing against said extension tube when said packing ring is fitted along with said connecting seat into said connecting bore of said base to prevent gas leakage and to maintain direction of the gas.

10. The jet type gas burner as defined in claim 1, wherein the adjusting rod of said control device passes into said lateral control bore of said base member, said adjusting rod having an externally threaded front portion which engages with said lateral control bore such that said adjusting rod may displace laterally within said lateral control bore, said adjusting rod further having a cylindrical first post sized to match the necked down portion of the gas passageway of said supply device at one end, and a second post at an opposite, said second post having an axial rod bore and a plurality of milled surfaces;

a detent screw having a through hole fitted onto said adjusting rod and threaded at a front portion thereof for engagement with said lateral control bore so that said detent screw may serve as a limit for the rearward displacement of said adjusting rod; and a control knob having a central through bore fitted onto said milled surfaces of said second post, and a screw driven through a knob hole into said axial rod bore of said adjusting rod for locking said knob and said adjusting rod so that said adjusting rod may displace within said lateral control bore upon turning of said control knob to open or close the necked down portion of the gas passageway of said gas supply device to control the amount of outflow gas.

11. The jet type gas burner as defined in claim 10, wherein at least one gasket is provided on a neck portion between said first post and said threaded front portion of said adjusting rod.

12. The jet type gas burner as defined in claim 11, wherein a cap is fitted onto said control knob.

13. The jet type gas burner as defined in claim 1, wherein said piezo-electric means of said ignition means has a lead wire extending into said burning device through a ceramic insulating spindle so as to contact a conductive needle disposed near the flame nozzle of the mixing tube of said burning device; and said activating push button consists of a first button element and a second button element extending from one side of said first button element parallel thereto, said second button element having a recess for accommodating said piezo-electric means and said conductive plate, said second button element pressing against an inner wall of said housing when said piezo-electric means retracts, preventing said activating push button from slipping out of said housing.

14. The jet type gas burner as defined in claim 13, wherein said housing has an opening in a lower portion thereof for exposing the threaded round bore of said base member, and a plurality of openings are respectively formed in said housing at suitable positions for exposing parts of said adjusting rod, said first button element of said activating push button and said mixing tube, said housing further having an annular rib and a plurality of positioning posts disposed at a lower portion thereof for positioning said base member which has a slot and a plurality of positioning bores at positions corresponding to said annular rib and said positioning posts, such that said base member and said housing may not be detached easily from each other after assembly.

* * * * *